US006070886A

United States Patent [19]

Cornelius et al.

[11] Patent Number: 6,070,886

[45] **Date of Patent: *Jun. 6, 2000**

[54] FRAME FOR AN IN-LINE SKATE

[75] Inventors: Dirk L. Cornelius, Oakdale; Gregor Mittersinker, Minneapolis, both of Minn.

[73] Assignee: Rollerblade, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/798,802

[22] Filed: Feb. 12, 1997

[51] Int. Cl.[7] ..... A63C 17/16; A63C 17/26

[52] U.S. Cl. ..... 280/11.22; 280/11.34; 280/809

[58] Field of Search ..... 280/11.12, 11.19, 280/11.2, 11.22, 11.3, 11.32, 11.34, 809, 811, 825; D21/224, 225, 226

[56] References Cited

U.S. PATENT DOCUMENTS

| | | | |
|---|---|---|---|
| D. 301,908 | 6/1989 | Olson et al. . | |
| D. 321,393 | 11/1991 | Olson et al. . | |
| D. 323,540 | 1/1992 | Graham . | |
| D. 324,713 | 3/1992 | Rubin . | |
| D. 334,225 | 3/1993 | Graham . | |
| 2,145,219 | 1/1939 | Burton . | |
| 2,998,260 | 8/1961 | Meyer | 280/7.13 |
| 3,756,614 | 9/1973 | Grubin | 280/11.22 |
| 4,199,879 | 4/1980 | Wegeng . | |
| 4,909,523 | 3/1990 | Olson . | |
| 5,046,746 | 9/1991 | Gierveld . | |
| 5,048,848 | 9/1991 | Olson et al. . | |
| 5,068,956 | 12/1991 | Malewicz . | |
| 5,092,614 | 3/1992 | Malewicz . | |
| 5,190,301 | 3/1993 | Malewicz . | |
| 5,331,752 | 7/1994 | Johnson et al. . | |
| 5,340,132 | 8/1994 | Malewicz . | |
| 5,374,072 | 12/1994 | Landers . | |
| 5,408,763 | 4/1995 | Sartor et al. . | |
| 5,505,470 | 4/1996 | Hoshizaki . | |
| 5,549,310 | 8/1996 | Meibock et al. | 280/11.22 |
| 5,570,894 | 11/1996 | Brandner | 280/11.22 |

FOREIGN PATENT DOCUMENTS

| | | |
|---|---|---|
| 0 684 055 A1 | 11/1995 | European Pat. Off. . |
| 1485766 | 12/1970 | Germany . |
| WO 95/03861 | 2/1995 | WIPO . |
| WO 96/01061 | 1/1996 | WIPO . |

OTHER PUBLICATIONS

"InLine Retailer & Industry News—Buyer's Guide", Jan. 1997, 19 pages.

"Box — Heartland TotoVision Cake Homework", Issue 10, 12 pgs. (Fall 1996), Oct. 1996.

*Primary Examiner*—Lanna Mai
*Assistant Examiner*—Bridget Avery
*Attorney, Agent, or Firm*—Merchant & Gould P.C.

[57] ABSTRACT

An in-line skate is disclosed having a rigid frame with a platform and having a boot with a shell. The shell includes a sole. Two longitudinal parallel rails extend downwardly from a lower side of the platform. A plurality of in-line skate wheels are secured to the frame. An upper side of the platform has first, second and third recesses in toe, heel and intermediate portions of the platform, respectively. A lower side of the sole of the boot has first, second and third projections in toe, heel and intermediate portions of the sole, respectively. The first, second and third projections of the sole matingly engage the first, second and third recesses of the platform, respectively, when the boot is coupled to the frame. Fasteners secure the boot to the frame at the first, second and third recesses of the frame. A block is disclosed including top and bottom sides. Sidewalls extend between the top and bottom sides. The block is supported between the longitudinal rails of the frame and is positioned between outer circumferences of two adjacent wheels. The block is spaced from each of the two adjacent wheels. A fastener is included for mounting the block to the frame and is entirely contained between planes defined by the longitudinal rails of the frame.

29 Claims, 12 Drawing Sheets

FRAME FOR AN IN-LINE SKATE

TECHNICAL FIELD

The present invention relates generally to the field of skates. More particularly, the present invention relates to roller skates having tandemly mounted wheels and eccentric spacers for mounting the wheels.

BACKGROUND

In recent years, roller skating and in-line skating have become extremely popular. Many participants in these sports have developed an interest in what is known as "aggressive" or "extreme" skating. Such skating includes jumping, flipping, sliding across raised surfaces, sliding down rails, and other similar types of maneuvers.

Skates generally have a frame and a boot coupled to the frame. The boots of many in-line skates include hard outer shells covering portions of a soft inner liner. Typically, the frame of a skate is made of plastic or metal and has a platform with an upper surface and a lower surface. The platform generally has a toe area and a heel area, with the heel area being vertically higher than the toe area. The boot has a sole and is positioned with the sole abutting the upper surface of the frame platform. The boot is typically attached to the frame by rivets that extend through the toe areas of the sole of the boot and the frame platform and through the heel areas of the sole of the boot and the frame platform.

Wheels are attached to a lower portion of the frame. Generally, the lower portion of the frame includes inner and outer elongated parallel rails each being longitudinally connected to the lower surface of the platform and aligned along a center portion of the platform such that the platform forms oppositely disposed inner and outer lateral flanges. The inner lateral flange extends outwardly from the inner rail and the outer lateral flange extends outwardly from the outer rail.

In one example of aggressive or extreme skating maneuvers, the outer rail and the lower surface of the outer lateral flange of the platform are used to slide or grind along raised surfaces such as, for example, concrete walls, metal rails and the like. The attached boot and its shell may also be used to slide or grind along raised surfaces and rails. In another type of extreme skating, a skater may jump onto a metal rail such that the longitudinal axis of the skate frame is transverse to the rail, with a portion of a bottom edge of the skate frame engaging the rail. Typically, skaters grind on a portion of the skate frame bottom edge, which is disposed between two middle wheels of a four-wheeled skate.

Some aggressive skates utilize what is known in the industry as an H-block. An H-block is typically a substantially square or rectangular block made of plastic. It is inserted between the longitudinal rails of the frame and is disposed between the two middle wheels. Generally, H-blocks are connected to the frame by a bolt or rivet which extends through the H-block and the inner and outer rails with a head of one end of the bolt abutting the outer side of one rail and a nut or other clamping device securing an opposite end of the bolt and abutting the outer side of the other rail.

As a skater builds momentum and lands on the rail as previously described, the portion of the skate frame bottom edge between the two middle wheels and an adjacent bottom side of the H-block will engage and slide along the rail. This type of sliding or grinding wears away the bottom edge of the skate frame and wears away the H-block to form a concave groove which enhances stability for grinding or sliding in this manner. Many skaters choose to purposely form a groove in this area of the skate frame and H-block to facilitate sliding or grinding on rails. Generally, new skates will have a flat bottom edge of the frame and an adjacent flat side of the H-block. Skaters often will use an abrasive surface or material to rub in this area to form a groove before trying to grind or slide across rails on this area of the skate.

A common problem with the prior art embodiments of H-blocks typically occurs when skaters are sliding or grinding on the lower surface of frame platform. If a skater is grinding along a frame platform, the outer side of the adjacent longitudinal rail often comes into contact with the surface upon which the skater is sliding. The head or nut of the bolt holding the H-block in place quickly wears away as it slides across an abrasive surface such as metal or concrete. Thus, H-blocks frequently come loose and skaters have to replace the bolts to maintain the stability of their H-blocks.

In aggressive or extreme skating, it is desirable to have a skate that evenly distributes forces upon the skate such that the skater experiences as smooth a transition as possible when landing from a jump. Generally, boots are attached to skate frames by two bolts or rivets, one in the toe area and one in the heel area. Thus, there is often a gap between the sole of the boot and the frame in the intermediate portion between the toe and heel areas. In addition, the typical two bolt toe and heel attachment of the boot to the frame is provided between substantially flat toe and heel portions of a sole and substantially flat toe and heel portions of a frame platform, respectively. In this type of skate, energy transfer from the skate frame to the boot is substantially perpendicular to the boot and is concentrated in the toe and heel areas. Thus, the skater may experience extreme loads under the toe and heel areas of the sole of the foot during aggressive skating maneuvers. In addition, concentrated loads produced on the toe and heel areas of the boot may affect stability of the skate when the toe and heel areas are flat and bolted to substantially flat toe and heel areas of a skate platform.

Other aggressive skate embodiments help accommodate stability but do not significantly enhance energy transfer from the frame to the skate. Such embodiments include rectangular or square projections from the toe and heel portions of the sole of the boot into corresponding rectangular or square recesses in the toe and heel portions of the platform of the frame. Consequently, the connection mechanism between the boot and the frame of a skate for aggressive skates needs to provide more stability and facilitate more even distribution of loads from the frame to the boot.

Other features desired by aggressive skaters include a low frame stance, rocketing ability, and the ability to replace the inner two wheels with wheels that are smaller than the outer two wheels while maintaining ground contact with all of the wheels. Typically, in-line skates use eccentric spacers to adjust the positioning of the various wheels. One example of an eccentric spacer is disclosed in commonly assigned U.S. Pat. No. 5,048,848. One desirable feature of an eccentric spacer is to maintain a low frame stance with various wheel sizes. It is also desirable for eccentric spacers to be configured to permit a skater to use a larger diameter wheel in the front and the back of the skate and to use a smaller diameter wheel in the middle two wheel positions of the frame while maintaining ground contact with all of the wheels. Smaller wheels in the middle two positions are desirable because they provide a greater distance between the wheels in the middle of the frame for grinding.

It is also desirable to have a spacer that permits rockering. Rockering is a term used to indicate that the lowest circumferential points of the front most and the rear most wheels are vertically higher from the ground than the lowest circumferential points of the wheels between the front most and rear most wheels of the skate. Thus a curved plane of ground contact is formed to permit "rockering" by the skater. Currently, eccentric spacers do not offer the combination of low frame stance for different sized wheels, rocketing ability, and the ability to replace the inner two wheels with wheels that are smaller than the outer two wheels while maintaining ground contact with all of the wheels.

Another desirable feature of in-line skates for aggressive skating is a pivoting cuff with a limited range of lateral movement by the cuff relative to the shell. Skaters often bend their legs and consequently put lateral stress on the cuff against the shell. A skate that does not permit any lateral movement can feel too rigid to the skater. Also, some current skates on the market provide small slots at the pivoting connection of the cuff and the lower shell to permit such movement. However, this design is not suitable because the slot permits lateral movement without any bias to bring the cuff to its normal position after the skater has finished bending.

The present invention provides a solution to these and other problems and offers other advantages over the prior art, as will be understood with reference to the summary, the detailed description and the drawings.

SUMMARY OF THE INVENTION

In accordance with the principles of the present invention, an in-line skate includes a rigid frame having a platform with upper and lower sides. Two longitudinal parallel rails extend downwardly from the lower side of the platform. A plurality of in-line skate wheels are secured between the longitudinal rails and are substantially aligned in a common plane. The platform has a toe portion, a heel portion and an intermediate portion. The upper side of the platform has a first recess in the toe portion, a second recess in the heel portion, and a third recess in the intermediate portion. The skate includes a boot having a shell with a sole. The sole has upper and lower sides with a toe portion, a heel portion and an intermediate portion. The sole has a first projection in the toe portion, a second projection in the heel portion and a third projection in the intermediate portion. The first, second and third projections of the sole matingly engage the first, second and third recesses of the platform, respectively, when the boot is coupled to the frame with the lower side of the sole of the shell abutting the upper side of the platform of the frame. Finally, first, second and third fasteners secure the boot to the frame at the first, second and third recesses of the frame.

In accordance with another embodiment of the present invention, a block is disclosed for use with an in-line skate having a rigid frame with a platform, a boot with sole, and a plurality of wheels rotatably mounted to the frame between two parallel longitudinal side rails extending downwardly from a lower side of the platform. The block includes a top side, a bottom side, and a plurality of sidewalls extended between the top side and the bottom side of the block. The block is supported between the longitudinal rails of the frame and is positioned between outer circumferences of two adjacent wheels. One of the sidewalls is spaced from and opposes one of the two adjacent wheels and another one of the sidewalls is spaced from and opposes the other one of the two adjacent wheels, such that each of the two adjacent wheels can freely rotate. A fastener is included for mounting the block to the frame. The fastener is entirely contained between planes defined by the longitudinal rails of the frame.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION

Reference will now be made in detail to exemplary embodiments of the present invention which are illustrated in the accompanying drawings. Wherever possible, the same reference numbers will be used throughout the drawings to refer to the same or like parts.

Figure 1:
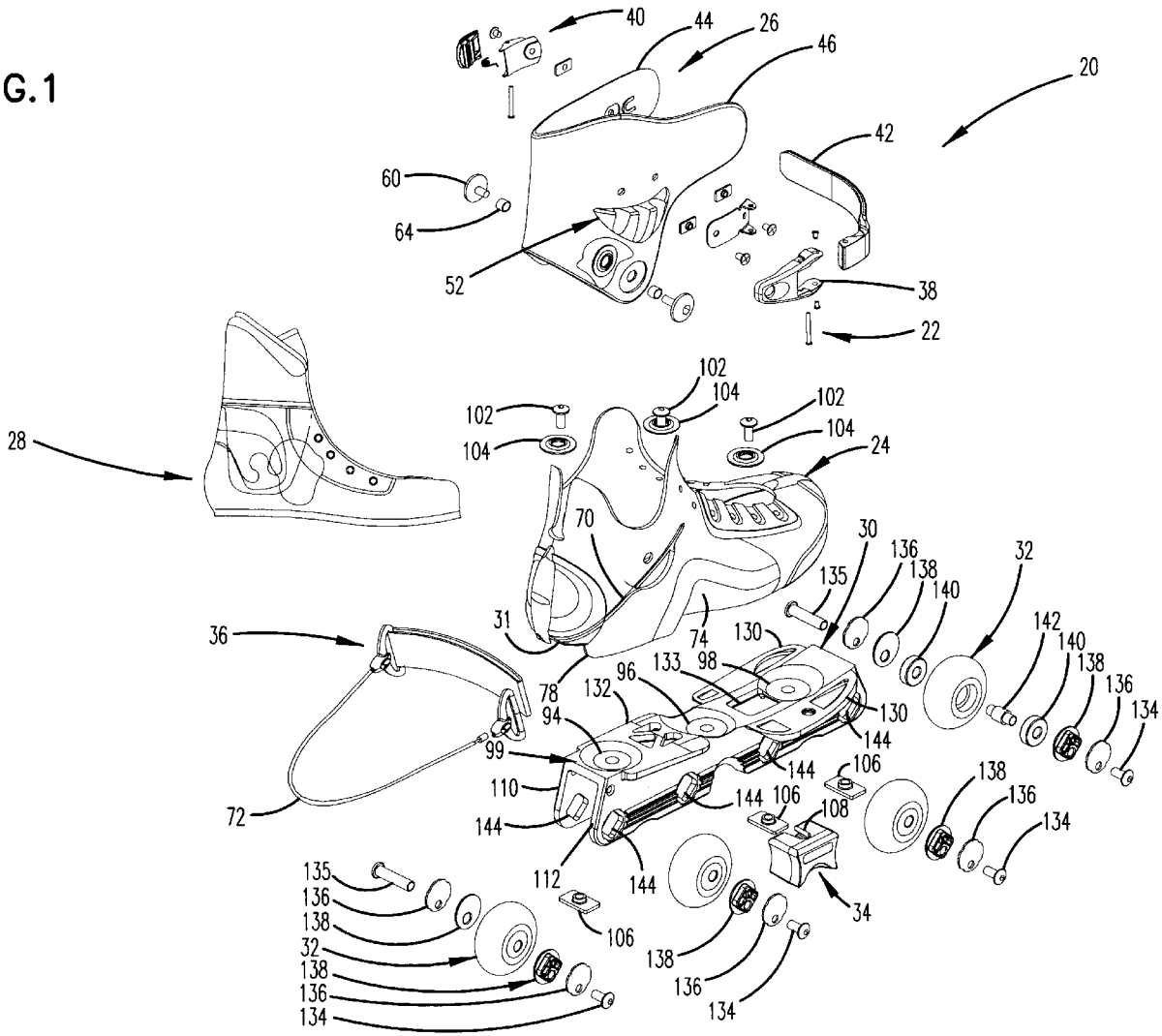
FIG. 1 is an exploded view of a skate constructed in accordance with the principles of the present invention.

FIG. 1 shows an exploded view of an exemplary in-line skate 20 constructed in accordance with the principles of the present invention. The illustrated skate 20 is a right skate which is used in combination with a left skate constructed in the mirror-image of the right skate 20. Generally, the skate 20 includes a boot 22 having a shell portion 24, a cuff portion 26 and a removable inner liner 28. A low-profile frame 30 is connected to a sole 31 of the shell portion 24 of the boot 22. A plurality of wheels 32 are mounted in tandem along the length of the frame 30. An H-block 34 is positioned between the wheels 32 and is connected to a mid-region of the frame 30. The skate 20 is also equipped with an optional power strap 36 for tightening the boot 22 about a user's ankle. The various components of the skate 20 will be described in greater detail in the following paragraphs. In particular, certain features will be described which are designed to accommodate the needs of an aggressive skater.

The shell 24 and cuff 26 of the boot 22 are preferably manufactured of wear resistant molded plastic. The cuff 26 includes an aluminum buckle 38 and a strap receiver 40 that cooperate to tighten a strap 42 about the cuff 26 (for clarity, these components are only illustrated in FIG. 1). The strap 42 is connected to the buckle 38 and has teeth that engage a locking pawl within the receiver 40 to secure the strap 42 about the cuff 26 and to allow the tightness of the strap 42 to be adjusted. The buckle 38 and strap receiver 40 are preferably connected to the cuff 26 via removable fasteners such as threaded rivets or bolts. Consequently, the buckle 30, strap 42 and strap receiver 40 can be removed from the cuff 26 and replaced without requiring replacement of the entire cuff 26 or boot 22.

The cuff 26 also includes an inside flap 44 and an outside flap 46 that are aligned generally with the strap 42. When the strap 42 is tightened about the cuff 26, the flaps 44 and 46 overlap one another and are adapted to conform generally about a user's shin region.

Figure 2:
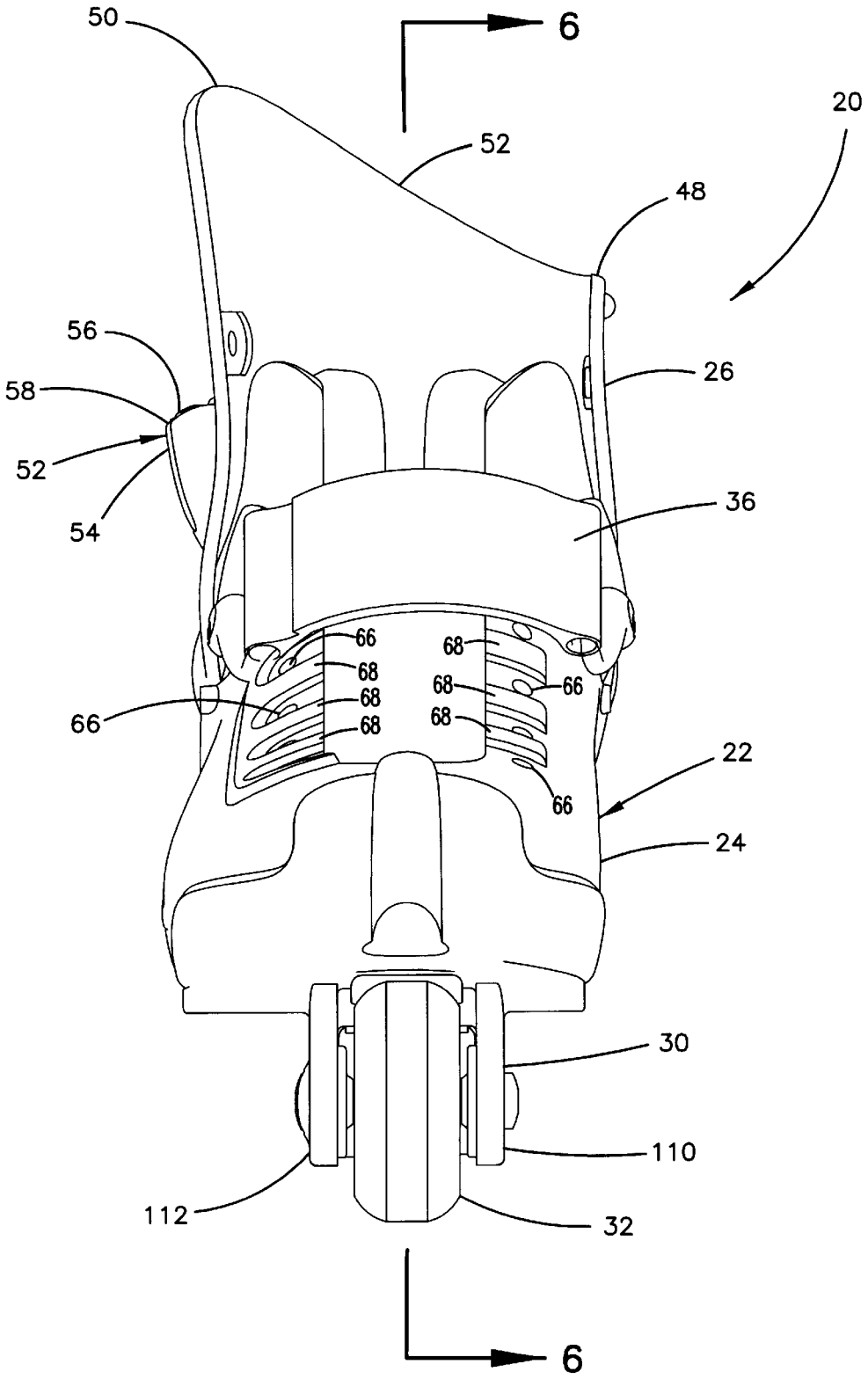
FIG. 2 is a front elevational view of the skate of FIG. 1.

As best shown in FIG. 2, the cuff 26 additionally includes inside and outside edges 48 and 50 that are asymmetrical. Specifically, the cuff's outside edge 50 has a higher elevation than the inside edge 48. A back edge 52 of the cuff 26 has a curved taper that provides a smooth transition between the inside and outside edges 48 and 50. The asymmetrical configuration of the cuff 26 provides outside support while concurrently allowing a user's foot to flex by limiting the inside ankle support.

Figure 3:
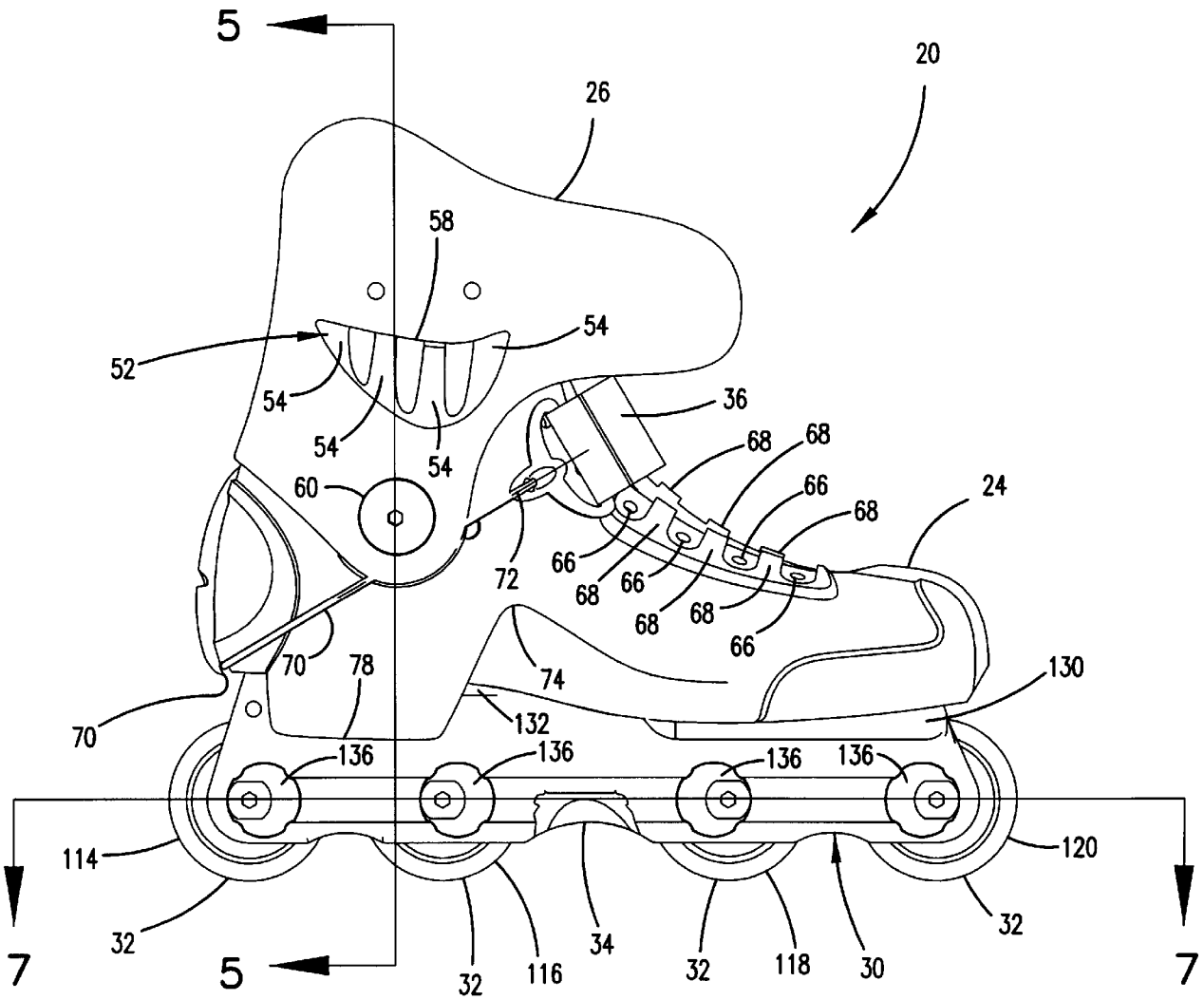
FIG. 3 is a side elevational view of the skate of FIG. 1.
Figure 4:
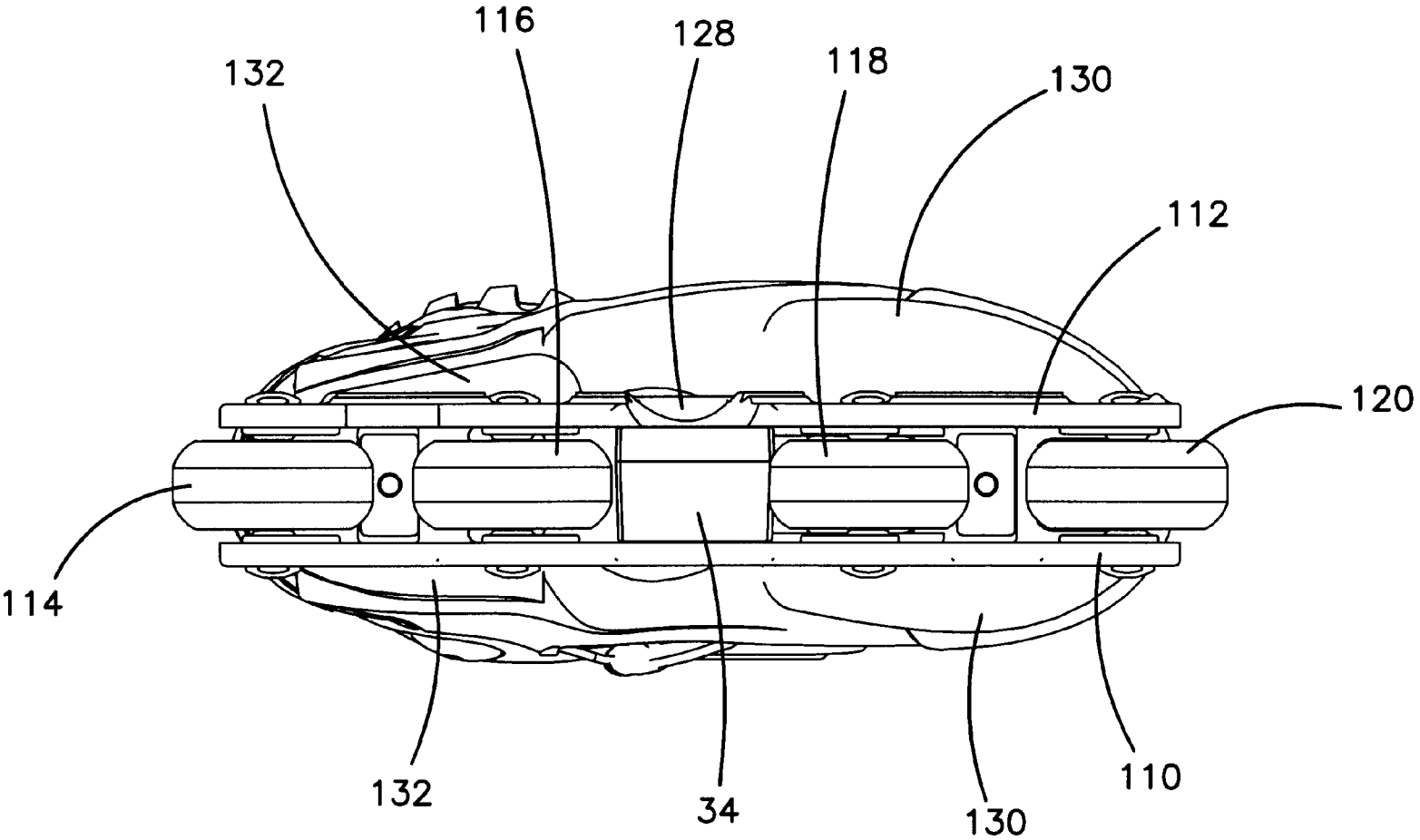
FIG. 4 is a bottom plan view of the skate of FIG. 1.

Referring to FIGS. 2 and 3, the cuff 26 is further equipped with structure for reducing wear of the buckle 38. For example, an integrally formed buckle protector 52 projects laterally outward from the outer side of the cuff 26. The buckle protector 52 has a generally triangular shape and includes four separate protective members. The protective members have outer wear surfaces 54 that taper laterally outward from the cuff 26. The protective members also form a shoulder 56 that projects transversely outward from the outer side of the cuff 26. The shoulder 56 intersects with the wear surfaces 54 at an outer edge 58. The shoulder 56 is located directly below the buckle 38 and preferably projects outward from the cuff 26 a sufficient distance to shield the buckle 38 from grinding. For example, the shoulder 56 preferably projects outward from the cuff 26 a sufficient distance such that when the buckle 38 is fastened, the buckle 38 is recessed with respect to the outer edge 58 of the buckle protector 52.

Figure 5:
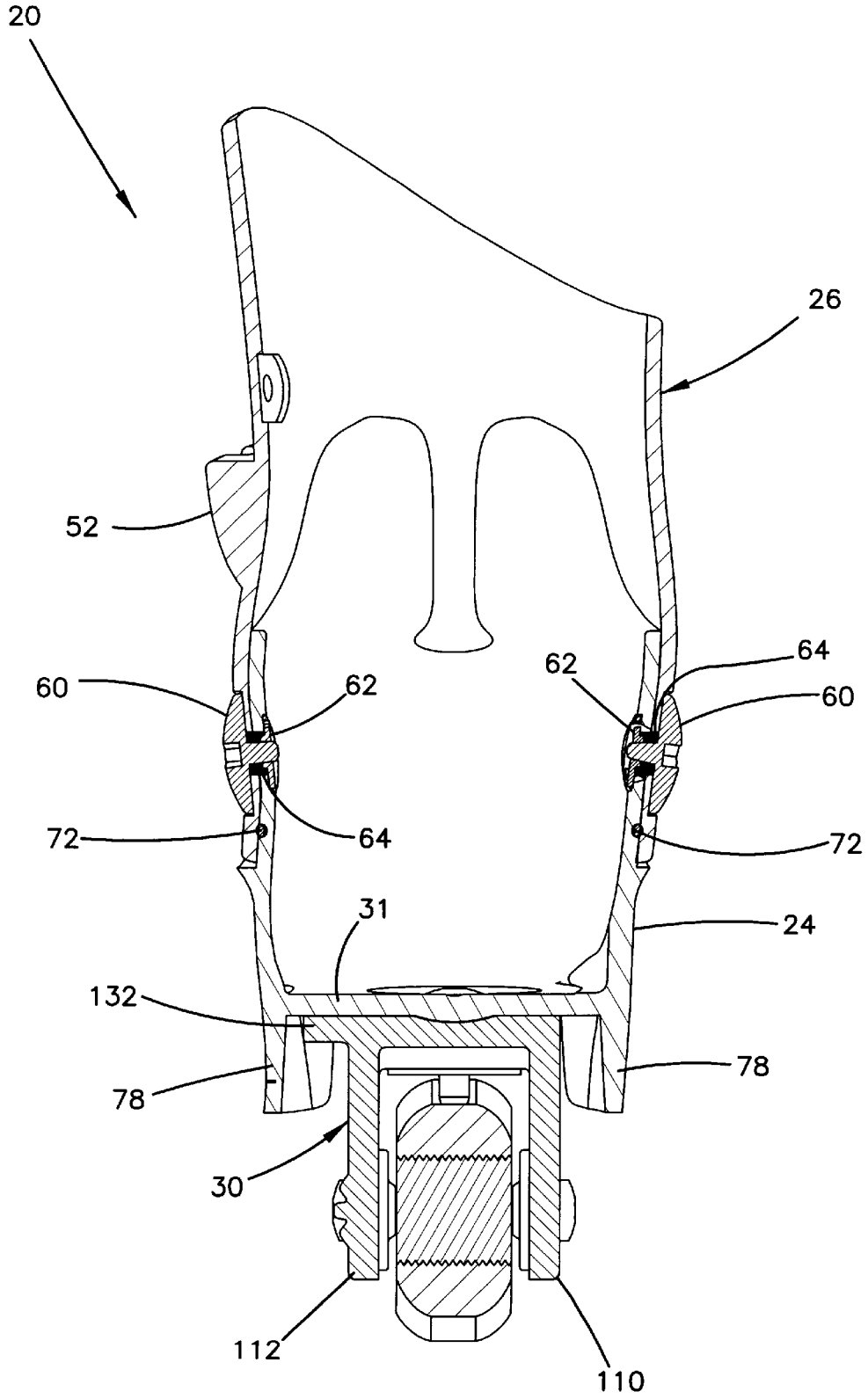
FIG. 5 is a cross-sectional view taken along section line 5—5 of FIG. 3.

As best shown in FIG. 5, the cuff 26 is connected to the shell 24 by a pair of pivot members that extend transversely through both the shell 24 and the cuff 26. The pivot members are preferably threaded bolts 60 that extend through co-axially aligned apertures defined by the shell 24 and the cuff 26. The bolts 60 are retained within the apertures by T-nuts 62 positioned within the shell 24. The heads of the bolts 60 fit within annular recesses defined by the outside of the cuff 26. An elastomeric member, such as a rubber washer 64, is mounted on each threaded bolt 60. The apertures defined by the shell 24 and the cuff 26 have diameters slightly larger than the outer diameters of the rubber washers 64. Consequently, when the bolts 60 are threaded within the T-nuts 62, the washers 64 fit within the apertures and function to center the bolts 60 within the apertures. The resilient nature of the washers 64 allows for a limited range of lateral movement between the cuff 26 and the shell 24. Although the bolts 60 are shown with the threaded ends adjacent to the shell 24, it will be apparent that the threaded ends could be adjacent to the cuff 26 with the T-nuts 62 or other similar clamping devices fitting within the annular recesses of the cuff 26.

The range of relative movement allowed by the washers is at least partially dependent upon the thickness of the washers (thickness being defined as the distance between the inner and outer diameters of each washer). Preferably, the washers have inside diameters of about 0.19 inches and outside diameters that range generally between 0.36–0.5 inches. Consequently, a preferred range of washer widths is 0.17–0.31 inches. The range of relative movement is also at least partially dependent upon the type of elastomeric material used to construct the washers. Exemplary washers have readings in the range of 55–65 Shore A durometers.

While the particular embodiment illustrated in the Figures shows both the shell 24 and the cuff 26 defining apertures sized to receive the elastomeric washers 64, in certain other embodiments, only the shell 24 or only the cuff 26 may include apertures sized to receive the washers 64.

Referring to FIGS. 2,3,9 and 10, the shell 24 of the boot 22 includes a plurality of first lace openings 66 for receiving boot laces. The lace openings 66 are preferably arranged to align with corresponding second lace openings in the liner 28. The shell 24 is equipped with structure for protecting the laces from the effects of grinding. For example, the shell 24 includes a plurality of lace protectors 68 that project upward from the top of the shell 24. The lace protectors 68 are positioned on opposite sides of each of the first lace openings 66. When boot laces are laced through the first openings 66, the laces are recessed with respect to the lace protectors 68 and thereby protected from the effects of grinding.

Figure 9:
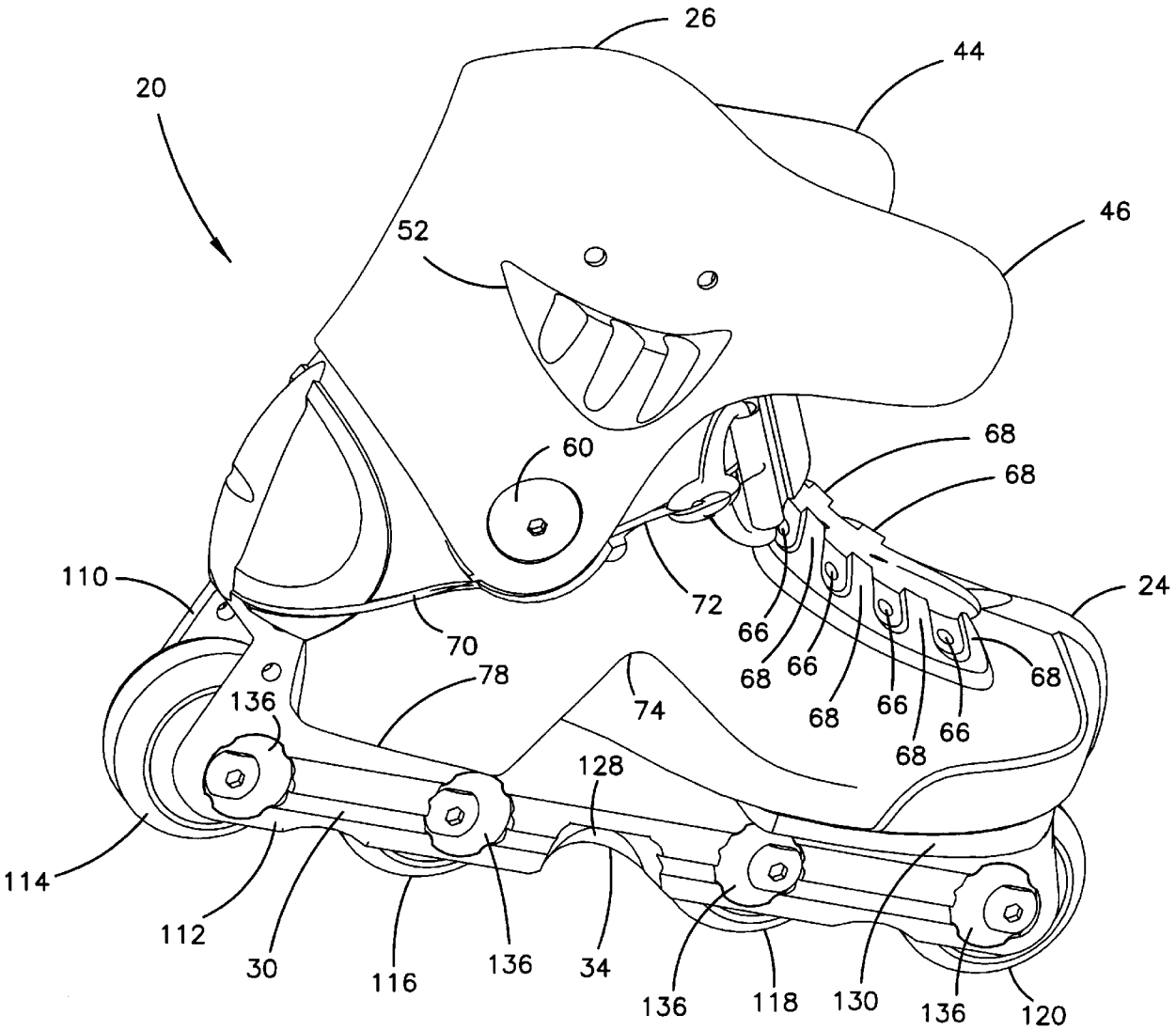
FIG. 9 is another perspective view of the skate of FIG. 1.
Figure 10:
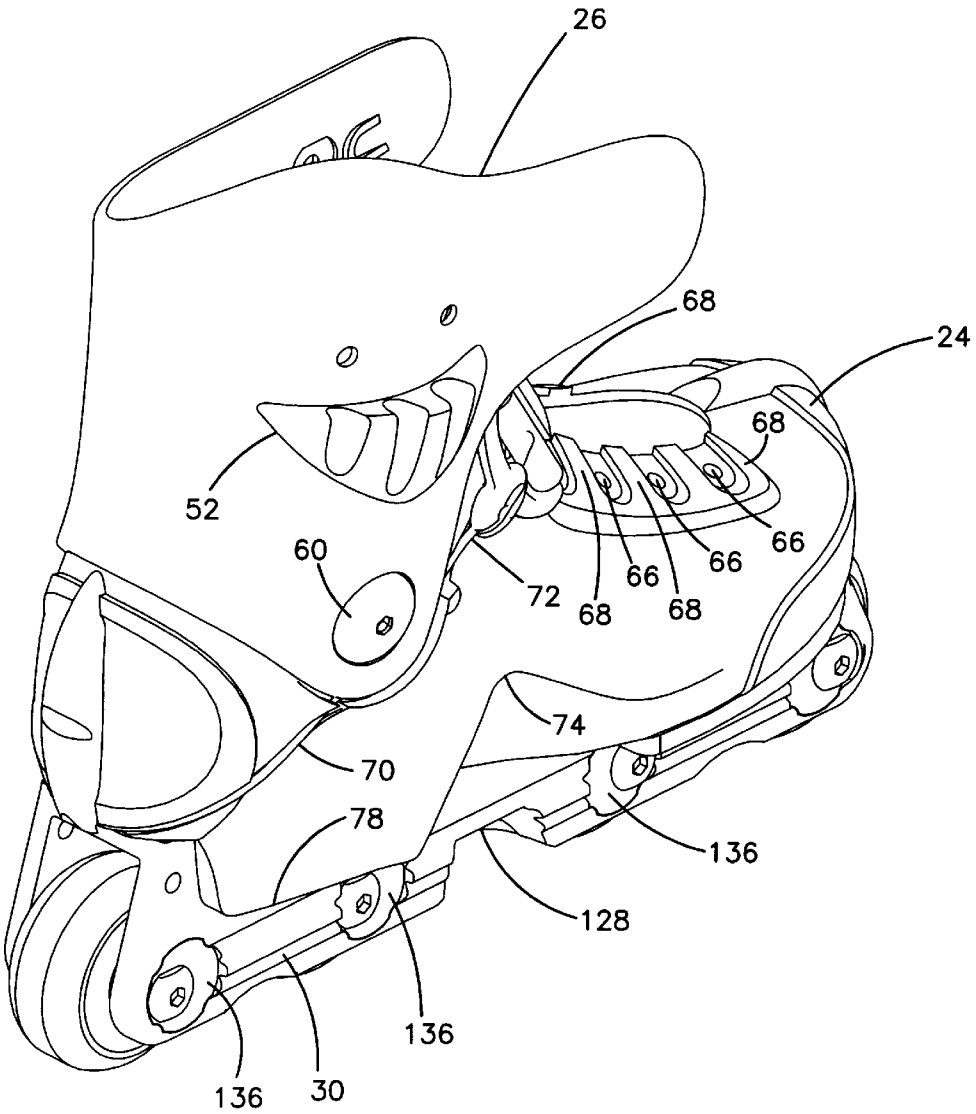
FIG. 10 is a further perspective view of the skate of FIG. 1.
Figure 11A:
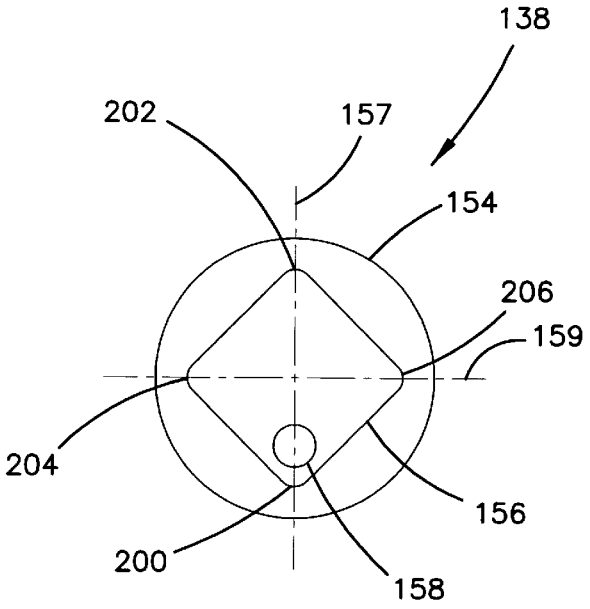
FIGS. 11A–11D schematically illustrate four different axle mounting positions that can be achieved with the eccentric diamond-shaped spacers shown in FIG. 1.
Figure 11B:
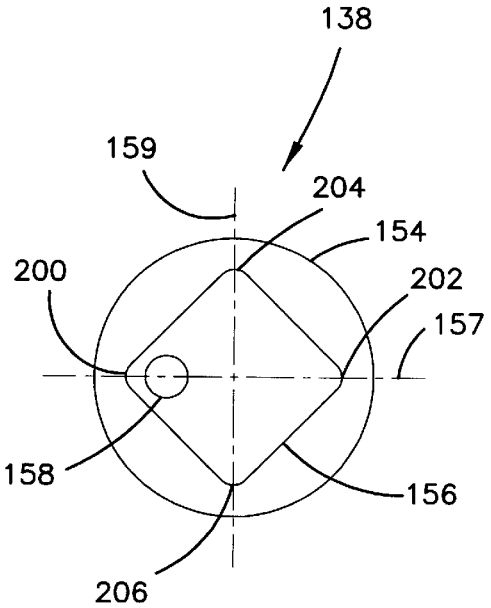
Figure 11C:
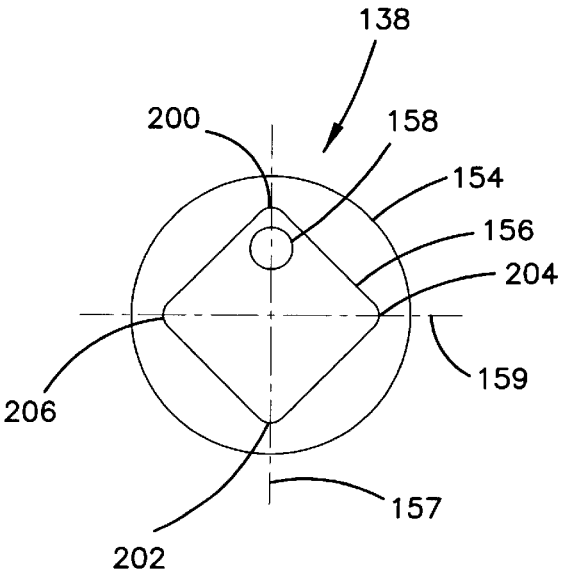
Figure 11D:
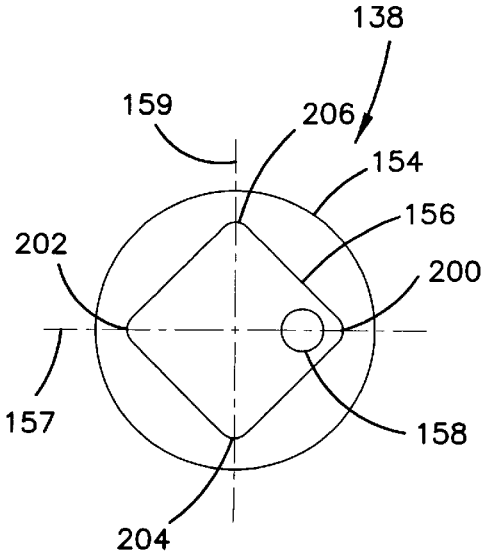

The shell 24 also includes structure for preventing the power strap 36 from being grinded. For example, as best shown in FIGS. 3, 9 and 10, the shell 24 includes a protective groove 70 configured to receive a cable 72 of the power strap 36 that loops around the heel of the shell 24. To accommodate the cable 72, the protective groove 70 extends along opposite sides of the shell 24 from the heel to the lace region. Portions of the protective groove 70 extend beneath the cuff 26. The protective groove 70 is preferably deep enough to completely inset the cable 72 within the shell 24.

The shell 24 additionally includes structure for encouraging grinding at a predetermined location along on the shell 24. For example, as shown in FIGS. 3 and 8–10, the shell 24 includes a generally V-shaped depression 74 formed by the outside, or lateral, surface of the shell. The deepest portion of the depression 74 is preferably aligned generally with the H-block 34 that is mounted on the central portion of the frame 30. When a skater slides on an object, the depression 74 channels the object toward the deepest portion of the depression 74 thereby controlling the location at which the shell 24 is grinded.

Figure 6:
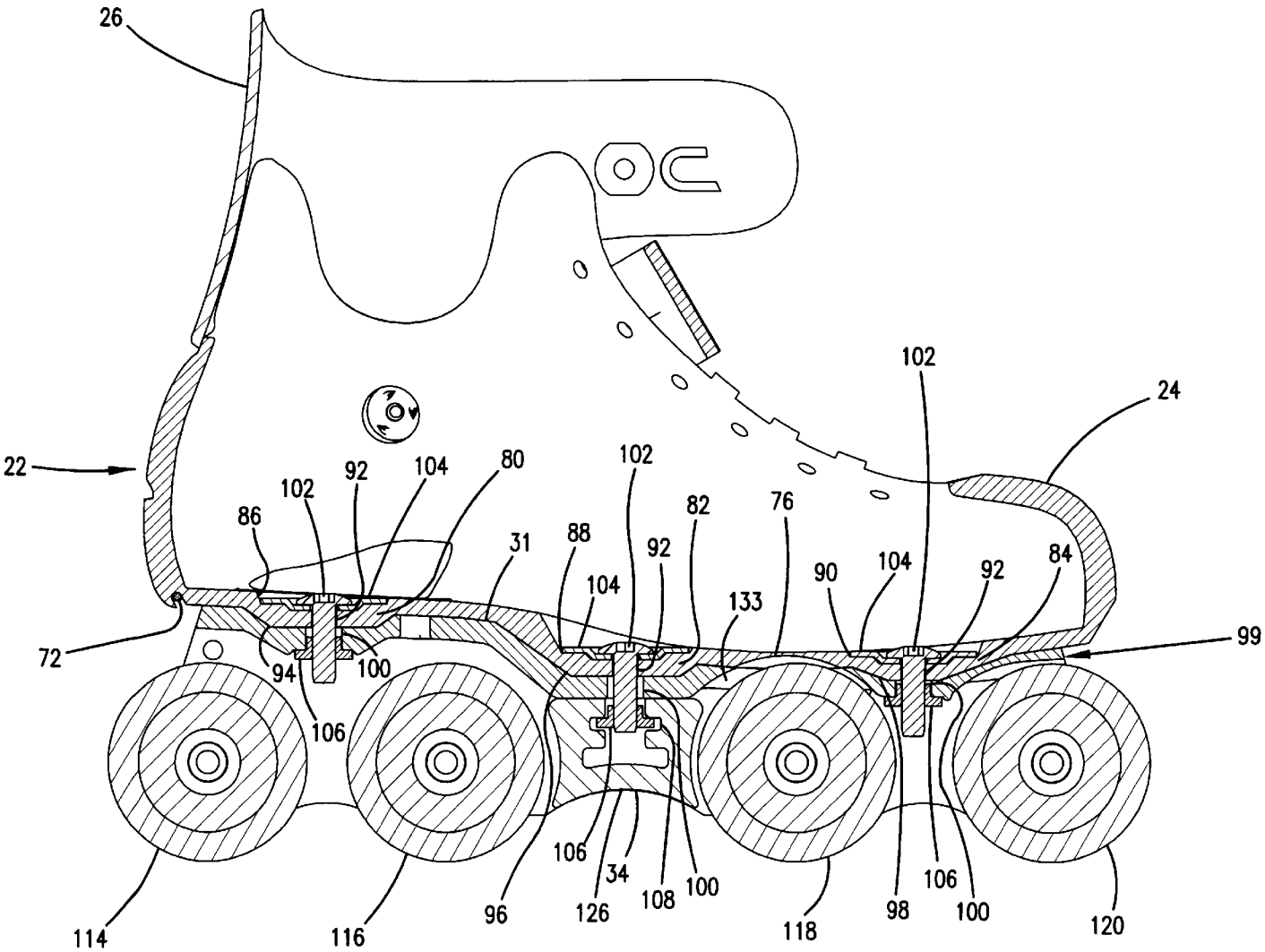
FIG. 6 is a cross-sectional view taken along section line 6—6 of FIG. 2.

The shell 24 also includes structure designed to complement the low-profile frame 30. For example, as shown in FIG. 6, the bottom of the sole of the shell 24 defines at least one curved recess 76 for providing clearance for one of the wheels 32 mounted on the frame 30. The positioning of the recess 76 is dictated by the anatomy of a typical foot. Specifically, when a foot is inserted within a boot, the lowest part of the foot is generally defined at the ball region of the foot. The profile of the frame 30 is directly dependent upon the elevational distance between the wheels 32 and the ball region of the foot. Consequently, to minimize the profile of the frame 30, it is desired to minimize the elevational distance between the wheels 32 and the ball region of the foot. This is preferably accomplished by positioning the recess 76 at a predetermined location along the sole of the shell 24 so as to generally coincide with the ball region of a typical foot. In this manner, the recess 76 is configured to provide clearance for a wheel positioned below the ball region of the foot such that a minimal elevational distance between the ball region and the wheel can be achieved.

The shell 24 additionally includes structure for providing a solid mechanical connection between the boot 22 and the frame 30. For example, the shell 24 includes a pair of integrally formed side members 78 that project downward from the bottom of the sole 31 of the shell 24. When the boot 22 is attached to the frame 30, the members 78 preferably straddle the frame 30 to resist lateral movement between the frame 30 and boot 22.

Another feature for providing a solid mechanical connection between the boot 22 and frame 30 relates to first, second and third conical projections 80, 82 and 84 that project outward from the bottom of the sole 31 of the boot 22 (best shown in FIG. 6). The conical projections 80, 82 and 84 are integrally formed with the shell 24 and respectively define first, second, and third conical washer recesses 86, 88; and 90 located along the interior of the shell 24. The first conical projection 80 is preferably located generally below a heel region of the boot 22. The second conical projection 82 is preferably located generally below an arch region of the boot 22. The third conical projection 84 is preferably located below a toe region of the boot 22. At approximately the center of each of the conical projections 80, 82, and 84, the shell 24 defines first bolt apertures 92 extending generally transversely through the sole 31 of the boot 22.

The first, second and third conical projections 80, 82, and 84 of the boot 22 are configured to fit within corresponding conical first, second, and third support recesses 94, 96, and 98 (shown in FIGS. 1 and 6) defined in a top surface of a platform 99 of the frame 30. At approximately the center of each of the conical support recesses 94, 96, and 98, the frame 30 defines second bolt apertures 100 extending generally transversely through the platform 99 of the frame 30. When the boot 22 is mounted on the frame 30, the first and second bolt apertures 92 and 100 are co-axially aligned.

The actual mechanical connection between the boot 22 and the frame 30 is provided by three bolts 102 that extend through the co-axially aligned sets of first and second apertures 92 and 100. The bolts 102 have heads that engage conical washers 104 that fit within the interior first, second and third conical washer recesses 86, 88, and 90 of the shell 24. The bolts 102 also have threaded ends that project outward from a bottom surface of the platform 99 of the frame 30. The ends of the bolts 102 are preferably threaded within T-nuts 106 located adjacent to the bottom side of the platform 99.

The T-nuts 106 associated with the first and third conical projections 80 and 84 of the boot 22 are compressed against the bottom side of the frame platform 99 to retain the bolts 102 within the bolt apertures 92 and 100. The T-nut 106 associated with the second projection 82 of the boot is inserted within a T-shaped slot 108 defined by the H-block 34. In this manner, the H-block 34 is connected to the frame 30 by the bolt 102 associated with the intermediate conical projection 82 of the boot 22. By tightening the bolt 102, the H-block 34 is compressed against the bottom side of the frame platform 99.

It will be appreciated that the term "conical" is intended to generally include a variety of tapered three-dimensional shapes such as truncated cones or truncated pyramids which are adapted to form a mating or nested connection. The shapes can by symmetrical or asymmetrical. The configuration of the mating/nested tapered portions is advantageous for numerous reasons. For example, the tapered configuration of the conical projections 80, 82, and 84 allows the skate to effectively transfer impact forces through the frame 30 to the boot 22 with reduced flexing of the frame 30. Specifically, the tapered projections 80, 82, and 84 help to spread the impact forces across the sole 31 of the boot 22. Additionally, a majority of the sole 31 of the shell 24 is in direct contact with the top surface of the frame platform 99. Such a large contact area also assists in spreading impact forces across the entire sole 31 of the boot 22. It will also be appreciated that because the conical projections 80, 82, and 84 are nested within corresponding recesses in the top surface of the frame platform 99, the projections 80, 82, and 84 function to resist relative lateral and longitudinal movement between the frame 30 and the boot 22.

The frame 30 of the skate 20 is configured for rotatably connecting the wheels 32 to the boot 22. For example, the frame 30 includes an inside mounting rail 110 and a outside mounting rail 112. The mounting rails 110 and 112 are spaced-apart and extend downward from the frame platform 99. The platform 99 extends transversely between the rails 110 and 112. The rails 110 and 112 cooperate to define a longitudinal channel for receiving the wheels 32. The wheels 32 mounted in the channel defined between the rails 110 and 112 include a rear wheel 114, a rear intermediate wheel 116, a front intermediate wheel 118, and a front wheel 120. The frame 30 is preferably constructed of approximately 28% glass-filled nylon, but can also be made of other materials such as metals, other types of glass-filled nylons, plastics and composites thereof.

Figure 7:
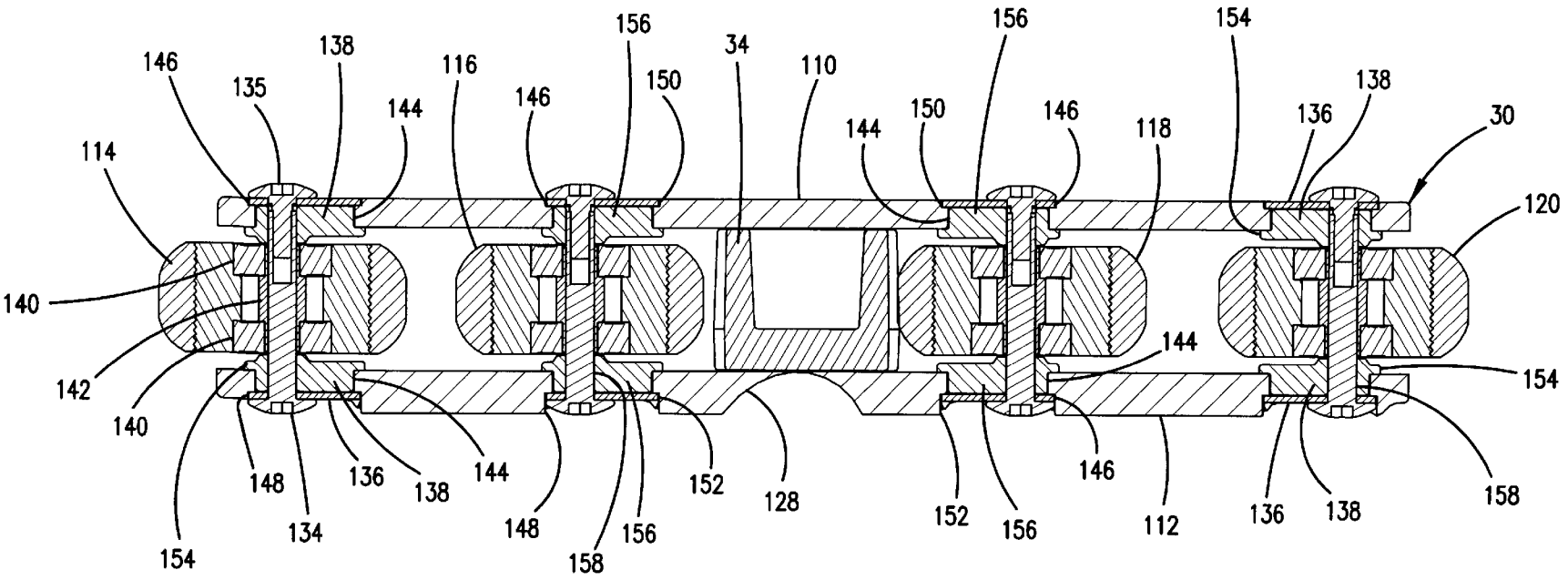
FIG. 7 is a cross-sectional view taken along section line 7—7 of FIG. 3.
Figure 8:
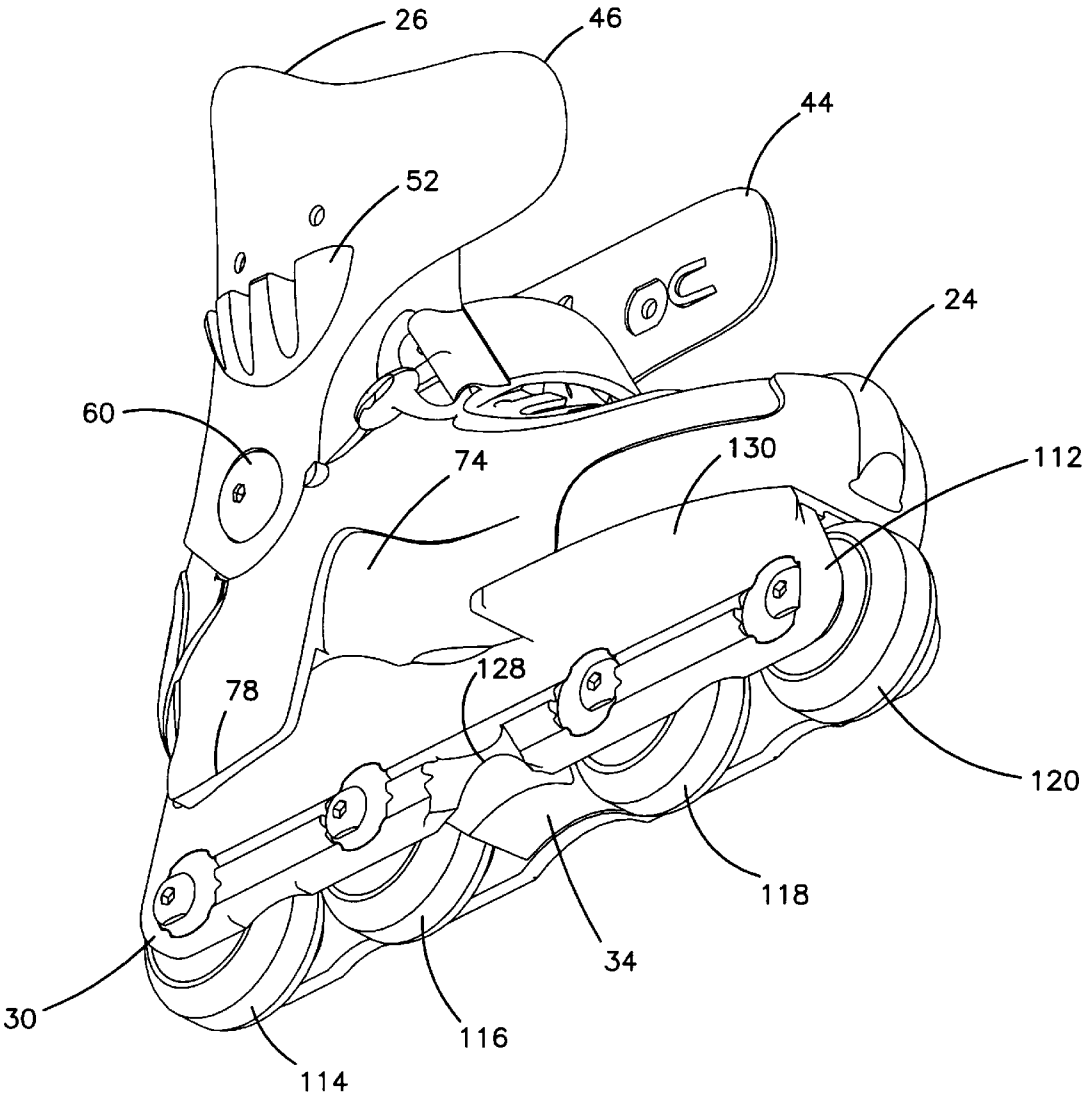
FIG. 8 is a perspective view of the skate of FIG. 1.

Referring to FIGS. 6 and 7, the H-block 34 is positioned between the front intermediate wheel 118 and the rear intermediate wheel 116. The H-block 34 is also positioned between the rails 110 and 112. The H-block 34 includes curved front and back surfaces that are configured to provide clearance for the front intermediate wheel 118 and the rear intermediate wheel 116. The H-block 34 also includes a curved bottom side 126. During aggressive skating, an skater uses the H-block 34 to slide upon objects such as hand rails. The bottom side 126 of the H-block 34 functions as a wear resistant channel adapted to be grinded during aggressive skating. To facilitate smooth grinding and to minimize frictional contact between the frame 34 and the grinding surface, the outside rail 112 has a cut-away slot 128 (best shown in FIGS. 7–10) which is aligned with a diagonal curve on the H-block 34.

As previously described, the H-block 34 is connected to the frame 30 by a bolt that extends transversely through the boot 22 and the frame platform 99. The transverse arrangement insures that all hardware for securing the H-block 34 to the frame 30 is concealed. Consequently, the metal hardware is protected from being grinded. The H-block 34 is preferably constructed of approximately 28% glass-filled nylon, but can also be made of other materials such as metals, other types of glass-filled nylons, plastics and composites thereof.

The frame 30 also is equipped with further features designed to facilitate grinding of the skate 20. For example, the frame 30 includes front wings or slide plates 130 that project laterally outward from opposite sides of the frame platform 99. Additionally, the frame 30 includes rear support plates 132 that project laterally outward from opposite sides of the frame platform 99. The front slide plates 130 preferably extend further outward from the frame platform 99 than the rear support plates 132 while the rear support plates 132 are preferably set higher than the front slide plates 130. As shown in FIG. 3, the rear support plates 132 are overlapped and straddled by the side members 78 of the shell 24. The side members 78 are preferably aligned in a common plane with the front slide plates 132 of the platform 99 to provide enhanced stability when sliding or grinding on the toe area of the platform 99.

For use in aggressive skating, it is desirable for a skate to have a low profile. Low profile skates are suited for providing a skater with enhanced control, stability and balance. Consequently, the frame 30 is equipped with various design features for lowering the profile of the skate 20. For example, the frame platform 99 includes a rectangular wheel opening 133 positioned between the front and intermediate conical support recesses 96 and 98. The wheel opening 133 extends transversely through the platform 99 and aligns with the recess 76 defined in the sole of the boot 22. When the wheels 32 are mounted on the frame 30, a portion of the front intermediate wheel 118 preferably projects through the wheel opening 133 and into the recess 76 defined by the boot 22. In this manner, the wheel 118 is positioned in close elevational proximity to the ball region of a users foot thereby reducing the profile of the skate 20. The distance between the outer boundary of the front intermediate wheel 118 and the bottom of the boot 22 is preferably in the range of 0.06–0.1 inches. Such a range is preferred to accommodate varying tolerances in wheel urethanes.

The skate profile is also dependent upon the arrangement used to mount the wheels 32 between the rails 110 and 112. In this regard, as shown in FIG. 1, each wheel 32 is connected to the rails 110 and 112 by a mounting assembly including an axle 134, a bolt 135, a pair of steel eccentric cam washers 136, a pair of four-way eccentric spacers 138, a pair of bearings 140, and an aluminum bearing spacer 142. As shown in the cross-sectional assembled view of FIG. 7, the bearing spacers 142 and the bearings 140 are mounted within the wheels 32. The eccentric spacers 138 are mounted within spacer openings 144 defined by the left and right rails 110 and 112. The cam washers 136 are inset within inside cam washer recesses 146 defined by the inside rail 110 and outside cam washer recesses 148 defined by the outside rail 112. The axles 134 extend through the cam washers 136, the eccentric spacers 138, the bearings 140 and the bearing spacers 144 to rotatably mount the wheels 32 between the rails 110 and 112.

The outside cam washer recesses 148 are preferably sufficiently deep such that the heads of the axles 134 are flush or slightly recessed with respect to the outside rail 112. In this manner, the heads of the axles 134 are protected from grinding Additionally, the inside and outside cam washer recesses 146 and 148 include inside and outside bearing shoulders 150 and 152 which are engaged by the cam washers 136. Preferably, the cam washers 136 are constructed of a material that is less flexible and has less give than the material used to construct the eccentric spacers 138. The preferred material for manufacturing the cam washers 136 is steel. However, it will be appreciated that other materials, such as metals, stainless steel, or stainless steel coated metals, can also be used. Preferred materials for manufacturing the eccentric spacer include plastic materials such as Delrin 100 ST plastic.

During normal use of the skate 20, the eccentric spacers 138 provide primary bearing support for the axles 134 with respect to the rails 110 and 112. However, when the skate 20 is subjected to high impact forces, typically caused by jumping, the eccentric spacers 138 have a tendency to slightly give, flex, yield, deform, or become over-stressed. The cam washers 136 cooperate with the bearing shoulders 150 and 152 of the cam washer recesses 146 and 148 to limit the amount the eccentric spacers 138 deform. Specifically, when the spacers 138 deform in response to impact forces, the cam washers 136 engage the shoulders 150 and 152 to provide additional bearing support to the axles 134. The supplemental support provided by the cam washers 136 prevents the eccentric spacers 138 from over-stressing. Additionally, it is noted that the skate 20 is constructed with the front intermediate wheel 118 in close proximity to the sole of the boot 22. In this regard, it is significant that the supplemental support provided by the cam washers 136 prevents the wheel 118 from engaging the bottom of the boot 22 when the skate is exposed to high impact forces.

Referring to FIGS. 1 and 11A–11D, the eccentric spacers 138 include round shoulder portions 154 and diamond-shaped spacer portions 156. Axle holes 158 are defined by the diamond-shaped spacer portions 156 of the eccentric spacers 138. The axle holes 158 are preferably positioned on first diagonals 157 which extend between first and second rounded corners 200 and 202 of the diamond-shaped spacer portions 156. The axle holes 158 are located generally adjacent to the first corners 200 of the spacer portions 156. Second diagonals 159 extend between third and fourth rounded corners 204 and 206 of the diamond-shaped portions 156 and perpendicularly intersect the first diagonals 157 generally at centers of the diamond-shaped portions 156. The diamond-shaped spacer portions 156 are sized to fit within the spacer openings 144 defined by the rails 110 and 112. When the spacers 138 are mounted on the rails 110 and 112, the diamond-shaped portions 156 fit within the spacer openings 144 and the shoulder portions 154 engage inside surfaces of the rails 110 and 112 (see FIG. 7).

Figure 12:
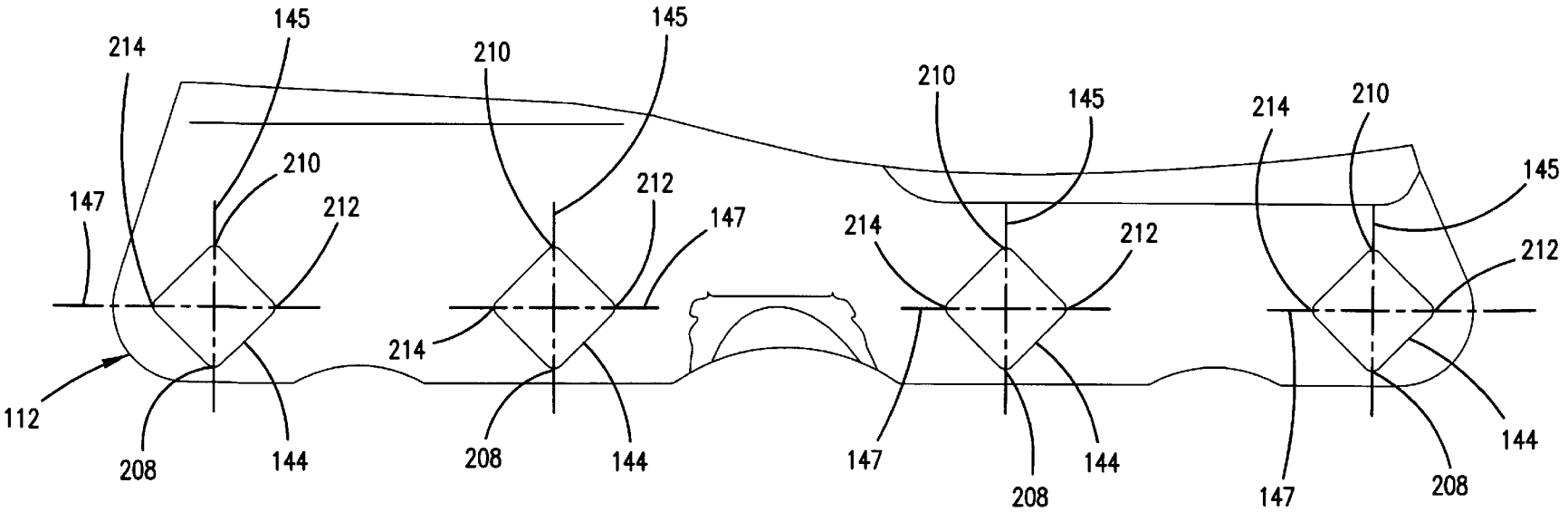
FIG. 12 schematically illustrates a side view of the skate frame shown in FIG. 1.

It will be appreciated that the spacer-openings 144 have diamond shapes that correspond to the diamond shapes of the spacers 138. As shown in FIG. 12, the spacer openings 144 are arranged such that rounded first corners 208 of the diamond-shaped openings 144 are positioned directly adjacent to the bottoms of the rails 110 and 112. A diagonal 145 extends between the first corner 208 and a second rounded corner 210 of each diamond shaped opening 144 and is preferably substantially perpendicular to the length of the rails 110 and 112 so as to typically be arranged in a vertical orientation. Another diagonal 147 extends between third and fourth rounded corners 212 and 214 of each diamond-shaped opening 144 and is preferably substantially parallel to the length of the rails 110 and 112.

In use, the eccentric spacers 138 allow each axle 134 to be set at four different locations relative to the frame 30. For example, the axle hole 158 of each spacer 138 can be moved between a forward position (shown in FIG. 11D), a lower position (shown in FIG. 11A), a rearward position (shown in FIG. 11B), and an upper position (shown in FIG. 11C).

In FIGS. 3, 4, 7, and 8–10, the two front axles are shown in the forward positions while the two rear axles are shown in the rearward positions. Such a configuration maximizes the space between the intermediate wheels 116 and 118 to facilitate grinding of the H-block 34. It will be appreciated that whenever the position of one of the sets of eccentric spacers 138 is changed, the position of the corresponding sets of eccentric cam washers 136 is also changed such that the eccentric axle holes in the washers 136 are maintained in alignment with the axle holes 158 of the eccentric spacers 138.

The eccentric spacers 138 allow wheels of varying sizes to be used with the frame 30. For example, by moving the front axle to the forward position, the rear axle to the rearward position, and the intermediate axles to the lower positions, smaller wheels can be mounted on the intermediate axles to increase size of the H-block 34 gap between the intermediate wheels while larger wheels can be mounted on the front and rear axles. In one particular illustrative embodiment, wheels having 65 mm radii are mounted on the front and rear axles while wheels having 55 mm radii are mounted on the intermediate axles. In such a configuration, the eccentric spacers allow the different sized wheels to maintain contact with the ground surface by raising the elevations of the front and rear axles by 10 mm with respect to the intermediate axles.

The spacers 138 can also be used for rockering the wheels 32 to simulate a hockey skate blade. This can accomplished by orienting the axle holes of the front and rear eccentric spacers in the upper positions, the axle hole of the front intermediate spacer in the forward position, and the axle hole of the rear intermediate spacer in the rearward position. Other configurations can also be utilized to rocker the skate 20.

The axle holes 158 of the spacers 138 are preferably positioned at predetermined locations along the diagonals of the diamond-shaped spacer portions 156 such that predetermined clearance spacings are maintained between the wheels, particularly the front intermediate wheel 118, and the sole 31 of the boot 22. For example, in one particular embodiment, when the axle holes 158 are in the forward or rearward positions, a wheel having a 55 mm radius will have a spacing distance of approximately ⅛ inch with respect to the sole of the boot. Similarly, when the axle holes 158 are in the lower position, a wheel having a 65 mm radius will also have a spacing distance of approximately ⅛ inch with respect to the sole of the boot. It will be appreciated that in such an embodiment, there is a 10 mm difference in elevation between the location of the axle holes when the spacers are in the forward or rearward positions, as compared to the location of the axle holes when the spacers are in the upper or lower positions. It will also be appreciated that by utilizing spacers 138 having axle holes 158 located at different positions along the diagonals of the diamond-shaped portions 156, an infinite number of wheel sizes can be utilized while maintaining the same predetermined spacing between the wheels and the boot 22.

The diamond-shaped spacers 138 and spacer openings 144 are advantageous for numerous reasons. For example, the diamond-shaped configuration, with the axle holes aligned on the diagonals, allows for large wheel spacing variations. The large variation in wheel spacing is achieved via spacers that occupy relatively small areas. Additionally, the arrangement of the diamond-shaped spacer openings 144 assists in transferring forces through the frame 30 and allows axles 134 to be placed in close proximity to the bottoms of the rails 110 and 112 without unduly weakening the frame 30.

It will be appreciated that the various components of the skate 20 can be sold in customized kits. For example, eccentric spacers and their corresponding eccentric washers can be sold in a kit with a set of wheels and an H-block. Preferably, the positioning of the axle holes within the eccentric spacers and washers is dependent upon and customized with respect to the diameters of the wheels. Because the spacers are customized with respect to the wheels, when the wheels are mounted on a skate, a predetermined clearance spacing will exist between the wheels and the sole of the skate boot. It is also preferred for the size and shape of the H-block to be customized with respect to the wheels to insure that the H-block will not interfere with the wheels when the wheels and H-block are mounted on a skate.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. An in-line skate comprising:

a rigid frame having a platform with upper and lower sides and having two longitudinal parallel rails extending downwardly from said lower side of said platform, said frame including a plurality of in-line skate wheels secured between said longitudinal rails and substantially aligned in a common plane;

said platform having a toe portion, a heel portion and an intermediate portion, said upper side of said platform defining a first recess in said heel portion, a second recess in said intermediate portion, and a third recess in said toe portion;

a boot including a shell with a sole, said sole having upper and lower sides and having a toe portion, a heel portion and an intermediate portion, said sole defining a first projection in said heel portion, a second projection in said intermediate portion and a third projection in said toe portion;

said first, second and third projections of said sole matingly engaging said first, second and third recesses of said platform, respectively, when said boot is coupled to said frame with said lower side of said sole of said shell abutting said upper side of said platform of said frame; and first, second and third fasteners for securing said boot to said frame at said first, second and third recesses of said frame.

2. The in-line skate of claim 1 wherein each of said first, second and third projections of said sole has a partial conical contour with a substantially flat truncated end; and wherein each of said first, second and third recesses of said platform has a partial conical contour with a substantially flat truncated end, said partial conical contours of said first, second and third recesses corresponding to said partial conical contours of said first, second and third projections, respectively.

3. The in-line skate of claim 1 wherein each of said first, second and third projections defines a hole therethrough; and wherein each of said first, second and third recesses defines a hole therethrough;

said holes of said first, second and third projections being coaxially aligned with said holes of said first, second and third recesses, respectively, forming first, second and third coaxially aligned pairs of holes when said boot is coupled to said frame with said lower side of said sole abutting said upper side of said platform; and each of said pairs of holes sized to operably receive one of said fasteners.

4. The in-line skate of claim 1 wherein at least a portion of said lower side of said sole is in continuous communication with said upper side of said platform along an entire length of said platform.

5. The in-line skate of claim 1 wherein said toe portion of said platform defines an opening therethrough, said opening aligned with one of said plurality of wheels such that a portion of said one of said plurality of wheels protrudes through said opening allowing said one of said plurality of wheels to rotate; and wherein said toe portion of said sole has a curved recess aligned with said opening of said platform for allowing said one of said plurality of wheels to rotate within said curved recess with said sole being spaced from said one of said plurality of wheels.

6. The in-line skate of claim 1 further comprising:

a block sized to be supported between said longitudinal rails of said frame and positioned between outer circumferences of two adjacent wheels of said plurality of wheels, said block spaced from each of said two adjacent wheels such that said two adjacent wheels can freely rotate; and a fastener for mounting said block to said frame, at least a portion of said fastener disposed below said platform, said portion of said fastener being entirely contained between said longitudinal rails of said frame.

7. The in-ine skate of claim 6 wherein each of said first, second and third projections defines a hole therethrough and each of said first, second and third recesses defines a hole therethrough;

said holes of said first, second and third projections being coaxially aligned with said holes of said first, second and third recesses, respectively, forming first, second and third coaxially aligned pairs of holes when said boot is coupled to said frame with said lower side of said sole abutting said upper side of said platform; and wherein said block includes top and bottom sides, said top side having a hole formed therein and abutting said lower side of said platform with said hole of said block coaxially aligned with said second pair of holes and sized to operably receive one of said fasteners.

8. An in-line skate comprising:

a rigid frame having a platform with upper and lower sides and having two longitudinal parallel rails extending downwardly from said lower side of said platform, said frame including a plurality of in-line skate wheels secured between said longitudinal rails and substantially aligned in a common plane;

said platform having toe and heel portions, said upper side of said platform defining at least a toe recess and a heel recess, said toe recess defined in said toe portion and said heel recess defined in said heel portion, each of said toe and heel recesses having a partial conical contour with a substantially flat truncated end;

a boot including a shell with a sole, said sole having upper and lower sides and having toe and heel portions, said lower side of said sole defining at least a toe projection and a heel projection, said toe projection defined in said toe portion and said heel projection defined in said heel portion, each of said projections having a partial conical contour with a substantially flat truncated end;

said toe and heel projections matingly engaging said toe and heel recesses when said boot is coupled to said frame with said lower side of said sole of said shell abutting said upper side of said platform of said frame; and at least two fasteners for securing said boot to said frame at said toe and heel recesses of said platform.

9. The in-line skate of claim 8 further comprising an intermediate fastener for securing said boot to said frame at an intermediate portion of said platform of said frame and an intermediate portion of said sole of said shell.

10. The in-line skate of claim 9 wherein said lower side of said sole of said shell defines an intermediate projection in said intermediate portion, said intermediate projection having a partial conical contour with a substantially flat truncated end defining a hole therethrough; and wherein said upper side of said platform of said frame defines an intermediate recess in said intermediate portion, said intermediate recess having a partial conical contour with a substantially flat truncated end defining a hole therethrough;

said intermediate projection matingly engaging said intermediate recess when said boot is coupled to said frame with said lower side of said sole of said shell abutting said upper side of said platform of said frame; and said holes of said truncated ends of said intermediate projection and said intermediate recess coaxially aligned and sized to operably receive said intermediate fastener.

11. The in-line skate of claim 9 wherein at least a portion of said lower side of said sole is in continuous communication with said upper side of said platform along an entire length of said platform.

12. A block for an in-line skate having a rigid frame, a boot with a sole, and a plurality of wheels, the frame having a platform with upper and lower sides and two parallel longitudinal side rails extending downwardly from the lower side of the platform, the plurality of wheels rotatably mounted between the longitudinal rails of the frame and substantially centered in a common plane, said block comprising:

a top side;

a bottom side;

a plurality of sidewalls extended between said top side and said bottom side;

said block sized to be supported between the longitudinal rails of the frame and positioned between outer circumferences of two adjacent wheels of the plurality of wheels, one of said plurality of sidewalls spaced from and opposing one of the two adjacent wheels and another of said plurality of sidewalls spaced from and opposing the other one of the two adjacent wheels;

a fastener for mounting said block to the frame, said fastener entirely contained between planes defined by the longitudinal rails of the frame and having one end completely encapsulated between said top and bottom sides; and said bottom side providing a continuous outer surface across an entire area defined by said bottom side.

13. The block of claim 12 wherein said top side of said block defines an opening coaxially aligned with an opening defined by the platform of the frame, said opening of said block and the opening of the platform sized to receive said fastener therethrough; and said fastener being operable by a user to adjust said fastener between a fastened position and an unfastened position, said block fixed from movement relative to the platform when said fastener is in said fastened position.

14. The block of claim 12 wherein said top side of said block abuts a portion of the lower side of the platform, one of said plurality of sidewalls abutting one of the longitudinal rails, and another one of said plurality of sidewalls abutting the other one of the longitudinal rails.

15. The block of claim 12 wherein said bottom side has a predefined concave shape as seen in a cross-section taken along the common plane of the plurality of wheels when said block is mounted to the frame.

16. The block of claim 15 wherein each of the longitudinal rails of the frame defines a recess having a concave shape corresponding to said concave shape of said block;

wherein at least one of the recesses of the longitudinal rails extends diagonally through a width of the longitudinal rail.

17. The block of claim 12 wherein said block is made of approximately 28% glass-filled nylon.

18. An in-line skate comprising:

a rigid frame having a platform with upper and lower sides and having two longitudinal parallel rails extending downwardly from said lower side of said platform, said frame including a plurality of in-line skate wheels secured between said longitudinal rails and substantially aligned in a common plane;

a boot with a sole including fasteners for mounting said boot to said frame; and a grinding block having a top side, a bottom side, and a plurality of sidewalls extended between said top side and said bottom side;

said grinding block sized to be supported between said longitudinal rails of said frame and positioned between outer circumferences of two adjacent wheels of said plurality of wheels, one of said plurality of sidewalls spaced from and opposing one of said two adjacent wheels and another of said plurality of sidewalls spaced from and opposing the other one of said two adjacent wheels; and a fastener for mounting said block to said frame, said fastener having one end completely encapsulated between said top and bottom sides; and said fastener having an opposite end protruding through a hole defined in said platform.

19. The in-line skate of claim 18 wherein said top side of said grinding block defines an opening and said platform defines an opening, said grinding block opening and said platform opening being coaxially aligned and sized to receive said fastener therethrough; and said fastener being operable by a user to adjust said fastener between a fastened position and an unfastened position, said grinding block fixed from movement relative to said platform when said fastener is in said fastened position.

20. The in-line skate of claim 18 wherein said top side of said grinding block abuts a portion of said lower side of said platform, one of said plurality of sidewalls abutting one of said longitudinal rails, and another one of said plurality of sidewalls abutting the other one of said longitudinal rails.

21. The in-line skate of claim 18 wherein said bottom side of said grinding block has a predefined concave shape as seen in a cross-section taken along said common plane of said plurality of wheels when said grinding block is mounted to said frame.

22. The in-line skate of claim 21 wherein each of said longitudinal rails of said frame defines a recess having a concave shape corresponding to said concave shape of said grinding block;

wherein at least one of said recesses of said longitudinal rails extends diagonally through a width of said longitudinal rail.

23. The in-line skate of claim 18 wherein said grinding block is made of approximately 28% glass-filled nylon.

24. The block of claim 12 further comprising a mass between said top and bottom sides;

said mass defining a generally T-shaped slot having one end in communication with said opening; and wherein said T-shaped slot is sized to receive said one end of said fastener therein.

25. The in-line skate of claim 19 wherein said grinding block defines a generally T-shaped slot extending from said opening to an interior portion of said block between said top and bottom sides, said slot sized to receive said one end of said fastener therein.

26. A frame for an in-line skate having a boot with a sole, said frame comprising:

a platform with upper and lower sides, said platform having two longitudinal parallel rails extending downwardly from said lower side of said platform, said rails spaced to rotatably receive a plurality of in-line skate wheels therebetween;

said platform having toe and heel portions, said upper side of said platform defining at least a toe recess and a heel recess, said toe recess defined in said toe portion and said heel recess defined in said heel portion, each of said toe and heel recesses having a partial conical contour with a substantially flat truncated end;

at least two fasteners for securing the boot to said frame at said toe and heel recesses of said platform.

27. The frame of claim 26 further comprising an intermediate fastener for securing the boot to said frame at an intermediate portion of said platform.

28. The in-line skate of claim 27 wherein said upper side of said platform defines an intermediate recess in said intermediate portion sized to operably receive said intermediate fastener.

29. A block for an in-ine skate having a rigid frame, a boot with a sole, and a plurality of wheels, the frame having a platform with upper and lower sides and two parallel longitudinal side rails extending downwardly from the lower side of the platform, the plurality of wheels rotatably mounted between the longitudinal rails of the frame and substantially centered in a common plane, said block comprising:

a top side;

a bottom side;

a plurality of sidewalls extended between said top side and said bottom side;

said block sized to be supported between the longitudinal rails of the frame and positioned between outer circumferences of two adjacent wheels of the plurality of wheels, one of said plurality of sidewalls spaced from and opposing one of the two adjacent wheels and another of said plurality of sidewalls spaced from and opposing the other one of the two adjacent wheels;

a fastener for mounting said block to the frame, said fastener having one end completely encapsulated between said top and bottom sides; and said fastener having an opposite end protruding through a hole defined in said platform.

* * * * *